US006315034B1

(12) United States Patent
Mahe et al.

(10) Patent No.: US 6,315,034 B1
(45) Date of Patent: Nov. 13, 2001

(54) AUTOMOBILE HEAT EXCHANGER MODULE COMPRISING A FAN SHROUD AND A HEAT EXCHANGER, IN PARTICULAR FOR MOTOR VEHICLE

(75) Inventors: Christian Mahe, Le Tremblay sur Mauldre; Carlos Alberto Martins, Villejuif, both of (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/582,612

(22) PCT Filed: Oct. 27, 1999

(86) PCT No.: PCT/FR99/02618

§ 371 Date: Oct. 24, 2000

§ 102(e) Date: Oct. 24, 2000

(87) PCT Pub. No.: WO00/26599

PCT Pub. Date: May 11, 2000

(30) Foreign Application Priority Data

Oct. 29, 1998 (FR) ..... 98 13586

(51) Int. Cl.[7] ..... F24H 3/02; F28F 9/00; B60K 11/00

(52) U.S. Cl. ..... 165/121; 165/67; 180/68.1; 248/213.3

(58) Field of Search ..... 165/121, 67, DIG. 311; 123/41.49; 180/68.1; 248/213.3

(56) References Cited

U.S. PATENT DOCUMENTS

| | | | | |
|---|---|---|---|---|
| 4,685,513 | * | 8/1987 | Longhouse et al. | 165/121 |
| 5,341,871 | * | 8/1994 | Stelzer | 165/121 |
| 5,498,130 | * | 3/1996 | Wakley et al. | 415/213 |
| 5,522,457 | * | 6/1996 | Lenz | 165/121 |
| 5,626,202 | * | 5/1997 | Barnes et al. | 180/68.1 |
| 5,704,418 | * | 1/1998 | Baader et al. | 165/121 |
| 5,875,836 | * | 3/1999 | Nakamura | 165/122 |

FOREIGN PATENT DOCUMENTS

| | | | |
|---|---|---|---|
| 37 44 644 A | | 7/1989 | (DE) . |
| 297 12 351 U | | 9/1997 | (DE) . |
| 0219 021 A | | 4/1987 | (EP) . |
| 2130304-A | * | 5/1984 | (GB) ..... 123/41.11 |

* cited by examiner

*Primary Examiner*—Ira S. Lazarus
*Assistant Examiner*—Tho Van Duong
(74) *Attorney, Agent, or Firm*—Liniak, Berenato, Longacre & White

(57) ABSTRACT

A heat exchanger module for a motor vehicle having a fan shroud mounted on a heat exchanger. The shroud includes two blocks that extend from a first side of a duct and are adapted to engage corresponding housings in a first manifold of the heat exchanger. Two spring clips extend from a second side of the fan duct and have an aperture for accommodating a lug projecting from a side face of a second manifold of the heat exchanger.

18 Claims, 2 Drawing Sheets

AUTOMOBILE HEAT EXCHANGER MODULE COMPRISING A FAN SHROUD AND A HEAT EXCHANGER, IN PARTICULAR FOR MOTOR VEHICLE

BACKGROUND OF THE INVENTION

1. Field of the Invention

The invention relates to heat exchangers, particularly for motor vehicles.

It relates more particularly to a heat-exchange module comprising a fan duct fitted to a heat exchanger with two manifolds.

2. Description of the Related Art

It is already known to fit a fan duct onto a heat exchanger, such as a radiator for cooling a motor-vehicle engine. In such an application, the fan duct is equipped with one or more motor-driven fan units in order to channel a flow of air suitable for sweeping the body or bank of the heat exchanger.

The fan duct is generally equipped with lugs which are fixed onto the manifolds of the heat exchanger by means of screws or the like. These are usually self-tapping screws inserted into blocks or bosses specially arranged on the manifolds of the heat exchanger Such assembly constitutes a lengthy operation and can [sic] compatible with the high rates of the assembly or fitting lines of the motor-vehicle industry.

The object of the invention is principally to surmount such a drawback.

SUMMARY OF THE INVENTION

To that end the invention proposes a heat-exchange module of the type defined in the introduction, in which the fan duct comprises at least two blocks which extend from a first side of the duct and which are suitable for being engaged in corresponding housings of a first manifold of the heat exchanger, as well as at least two spring clips which extend from a second side of the fan duct in a direction opposite to the blocks, the said clips each being equipped with an aperture suitable for letting through a lug projecting from a side face of a second manifold of the heat exchanger.

Hence, in order to fit the fan duct onto the heat exchanger, it is sufficient to engage the blocks of the duct into the housings of the first manifold and to engage the lugs of the duct into the corresponding apertures of the clips. This assembly operation makes it possible to produce a module without having to resort to fixing screws, or the like, and to tools.

In one preferred embodiment of the invention, each clip hangs from a stirrup which is attached to the second side of the fan duct and which leaves an aperture capable of being traversed by a pin integral with one end wall of the manifold, in such a way that the fitting of the fan duct onto the heat exchanger comprises a final insertion phase in which the blocks penetrate into the housings and simultaneously the pins penetrate into the apertures of the stirrups.

According to yet another characteristic of the invention, each stirrup comprises a bridge in which the aperture is formed, and to which the clip is attached, as well as two branches linking the bridge to the second side of the fan duct, in such a way that, during the final phase of the insertion, the clip is first of all pushed away laterally under the action of the lug then closes back, allowing the lug to penetrate into the aperture in the clip.

Advantageously, each lug comprises a sloping wall, forming a ramp, in order to facilitate the pushing-away of the clip.

In one preferred embodiment of the invention, the fan duct comprises two clips, spaced apart, one of which is suitable for providing a positioning reference and the other for taking up dispersion between the second manifold and the fan duct.

The housings of the first manifold are preferably each formed by a U-shaped stirrup.

In one preferred embodiment of the invention, the fan duct comprises three spaced blocks suitable for being engaged respectively in three housings of the first manifold.

Advantageously, the fan duct as well as its blocks and its clips are produced in a single piece by moulding from a plastic.

Likewise, it is advantageous for the first manifold and its housings to be produced in a single piece by moulding from a plastic. Likewise, the second manifold and its lugs are advantageously produced in a single piece by moulding from a plastic.

In one preferred embodiment of the invention, the first manifold and the second manifold are intended to extend horizontally, respectively at the lower part and at the upper part of the heat exchanger.

In one preferred application of the invention, the heat exchanger constitutes a radiator for cooling a motor-vehicle engine.

In the description which follows, given by way of example, reference is made to the attached drawings, in which:

DETAILED DESCRIPTION OF THE PREFERRED EMBODIMENTS

Figure 1:
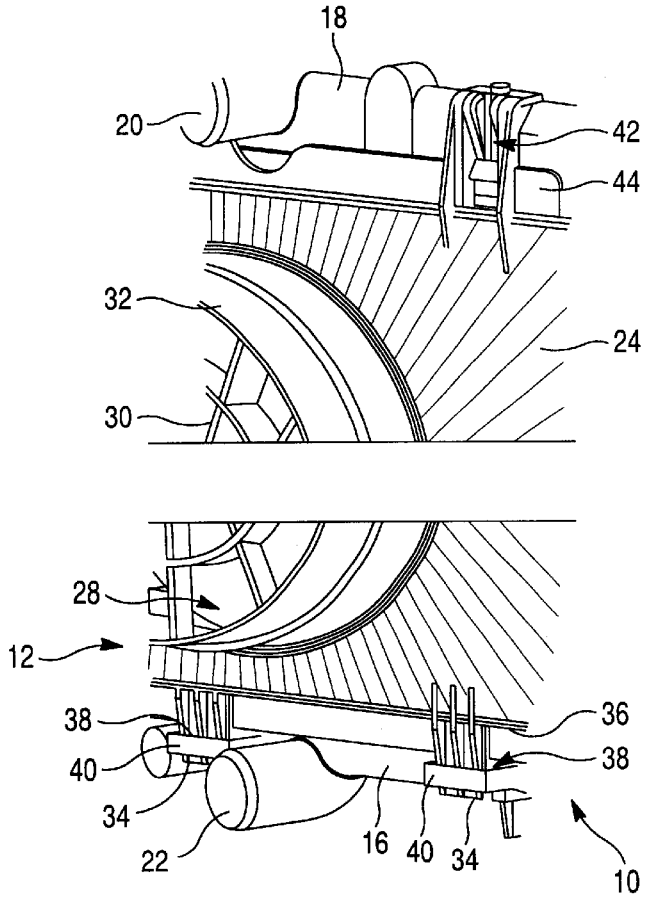
FIG. 1 is a partial view in perspective of a module according to the invention comprising a fan duct fitted onto a heat exchanger.
Figure 4:
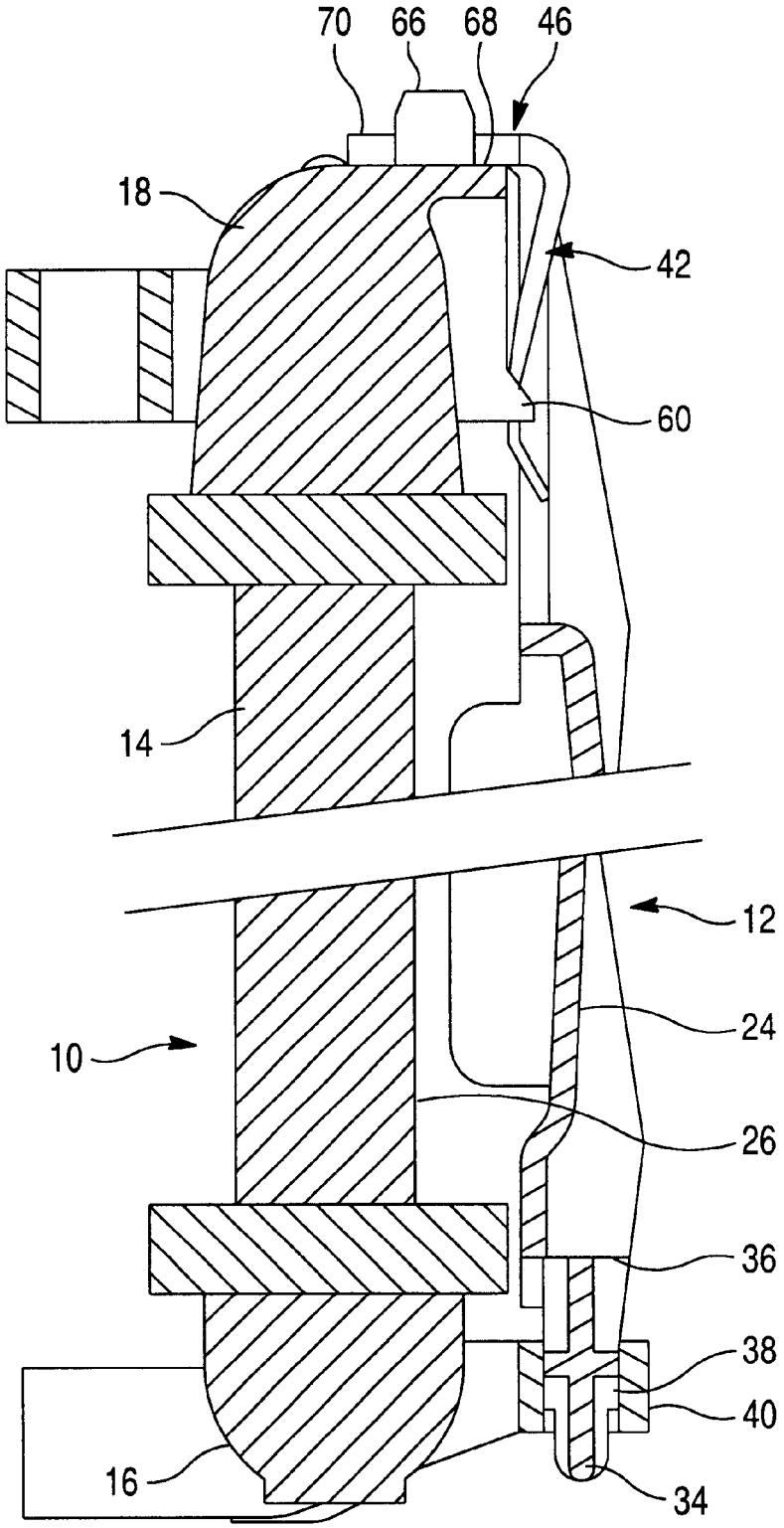
FIG. 4 is a view in vertical section of the module of FIG. 1.

The module represented in FIGS. 1 and 4 comprises a heat exchanger 10, here consisting of a radiator for cooling a motor-vehicle engine, onto which a fan duct 12 is fitted.

The heat exchanger 10 comprises a body or bank 14 formed by vertical tubes (not represented) which are linked respectively to a first manifold 16 and to a second manifold 18. These two manifolds are generally horizontal in direction, and are intended to be placed respectively at the lower part and at the upper part of the heat exchanger.

The latter comprises an inlet pipe 20 and an outlet pipe 22 (FIG. 1) serving respectively for taking in and for discharging a liquid running through the heat exchanger, in this example a liquid for cooling a motor-vehicle engine. Thus, this liquid runs through the heat exchanger in a descending vertical direction.

The manifolds 16 and 18 are produced by moulding from a plastic, for example of the polypropylene type.

The fan duct 12 comprises (FIG. 1) a back plate 24 of generally rectangular shape which is designed to extend parallel to and opposite a large face 26 (FIG. 4) of the body 14 of the exchanger. This back plate leaves a circular aperture 28 (FIG. 1) which is intended to house a motor-driven fan unit (not represented) comprising an electric motor driving a propeller. This motor-driven fan unit is supported by an open structure 30 attached to a circular cylindrical wall 32 attached to the back plate 24. The assembly constituted by the back plate 24, the open structure 30 and the cylindrical wall 32 is produced in a single piece by moulding from a plastic, in particular of the polypropylene type, so as to constitute the fan duct in its entirety.

This fan duct is intended to be fitted to the heat exchanger, in such a way that the motor-driven fan unit can force a flow of air, by blowing or by suction, and that this flow is channelled so as to sweep the body 14 of the heat exchanger and cool the liquid which runs through this heat exchanger.

In order to carry out this assembling, the invention makes provision for the fan duct 12 to comprise, at its lower part, three blocks 34 (only two of which are visible in FIG. 1). These blocks extend from a first side 36 (lower horizontal side) of the duct 12 and are directed vertically downwards. These blocks thus extend substantially in the plane defined by the back plate 24 of the duct 12. A central block is advantageously provided, bracketed by two lateral blocks, these blocks being moulded integrally with the fan duct 12.

These three blocks 34 are suitable for being engaged in respective housings 38 formed by U-shaped stirrups 40, moulded integrally with the manifold 16 (FIGS. 1 and 4). Hence the blocks 34 can be inserted simultaneously into the housings 38 by a substantially vertical downward movement.

Figure 2:
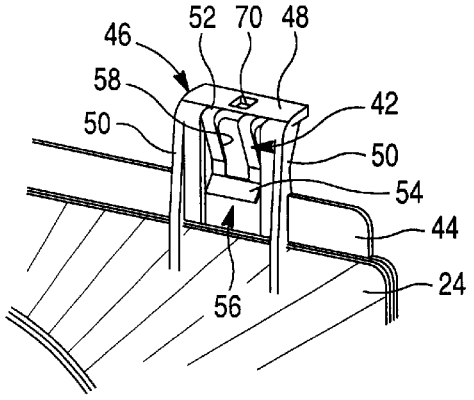
FIG. 2 is a partial view in perspective of the fan duct of the module of FIG. 1.

The fan duct 12 further comprises two clips 42 (FIGS. 1, 2 and 4), only one of which is visible in FIG. 1. These two clips are both attached to a second side 44 (upper horizontal side) of the duct 12, in such a way as to extend on the opposite side to the blocks 34.

Each of the clips 42 (FIG. 2) hangs from a stirrup 46 which is attached to the second side 44 of the fan duct. More particularly, this stirrup 46 comprises a bridge 48 to which the clip is attached, as well as two parallel branches 50 linking the bridge 48 to the side 44 of the fan duct. These branches 50 extend in the continuation of the back plate 24 of the duct. The bridge 48 constitutes a plate of generally rectangular shape which extends in a plane substantially perpendicular to that of the back plate 24 and which is provided with an aperture 70.

The clip 42 is a spring clip which has one end 52 linked to the bridge 48 and one curved end 54 turned towards the side 44 of the duct, and which extends parallel to this side. The clip 42 is capable of being pushed away elastically by deflecting within the housing 56 which is delimited between the two parallel branches 50.

Figure 3:
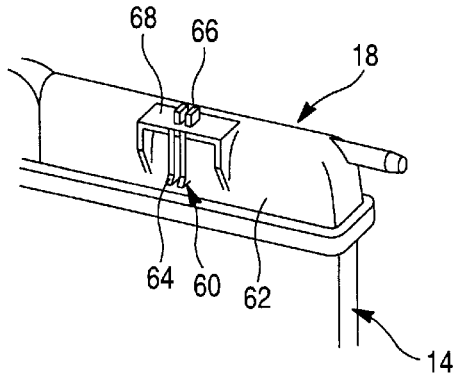
FIG. 3 is a partial view in perspective of the heat exchanger forming part of the module of FIG. 1.

This clip 42 includes an internal aperture 58 suitable for letting through a lug 60 (FIGS. 1, 3 and 4) projecting from a side face 62 of the manifold 18. Each lug 60 comprises a sloping wall 64 forming a ramp.

Close to each lug 60 a pin 66 is provided (FIGS. 1, 3 and 4), which extends from an end face 68 of the manifold 18, this end wall being substantially perpendicular to the side wall 62 on which the lug 60 hangs.

The clips 42 and the corresponding stirrups 46 are moulded integrally with the fan duct 12. Likewise, the lugs 60 and the pins 66 are moulded integrally with the manifold 18.

In order to fit the fan duct onto the heat exchanger, it is sufficient first of all simultaneously to engage the three blocks 34 in the corresponding housings 38 of the manifold 16, then to make the duct 12 pivot so as to bring the side 44 of the duct close up against the upper manifold 18. This closing movement is carried out essentially by a pivoting or swinging movement. Next, when the pins 66 are opposite the apertures 70 of the stirrups 46, it is sufficient to move the duct by a translational movement. This allows the blocks 34 to engage fully into the housings 38 and the pins 66 to engage fully into the apertures 70. During this final insertion phase, the clips 52 are first of all pushed away, under the action of the ramps 64 of the lugs 60, then closed back again when the lugs 60 engage in the apertures 58 of the clips 42. The clips thus provide the locking of the duct and of the exchanger which are held immobilised with respect to one another.

It should be noted that the clips 42 are not necessarily strictly identical. Hence, it is advantageous for one of these clips to be suitable for providing a positioning reference and for the other to be suitable for taking up dispersion between the manifold 18 and the fan duct 12.

Obviously, the invention is not limited to the embodiment described above by way of example and extends to other variants.

In all instances, the fitting of the duct onto the exchanger is done in a secure away without it being necessary to use fixing means, of the screw type or the like, and tools.

Although the invention has been described by particular reference to a heat exchanger comprising two horizontal manifolds, it could be applied to other types of heat exchangers, in particular with vertical manifolds.

What is claimed is:

1. Heat-exchange module comprising a fan duct (12) fitted to a heat exchanger (10) with two manifolds, wherein the fan duct (12) comprises a least two blocks (34) which extend from a first side (36) of the duct and which are suitable for being engaged in corresponding housings (38) of a first manifold (16) of the heat exchanger, as well as at least two spring clips (42) which extend from a second side (44) of the duct, in a direction opposite to the blocks (34), the clips (42) each being equipped with an aperture (58) suitable for letting through a lug (60) projecting from a side face of a second manifold (18) of the heat exchanger.

2. Module according to claim 1, wherein each clip (42) hangs from a stirrup (46) which is 20 attached to the second side (44) of the fan duct and which leaves an aperture (70) capable of being traversed by a pin (66) integral with one end wall (68) of the manifold (18), in such a way that the fitting of the fan duct onto the heat exchanger comprises a final insertion phase in which the blocks (34) penetrate into the respective housings (38) and simultaneously the pins (66) penetrate into the apertures (70) of the stirrups.

3. A Heat-exchange module comprising a fan duct (12) fitted to a heat exchanger (10) with two manifolds, the fan duct (12) includes at least two blocks (34) which extend from a first side (36) of the duct and which are suitable for being engaged in corresponding housings (38) of a first manifold (16) of the heat exchanger, as well as at least two spring clips (42) which extend from a second side (44) of the duct, in a direction opposite to the blocks (34), the clips (42) each being equipped with an aperture (58) suitable for letting through a lug (60) projecting from a side face of a second manifold (18) of the heat exchanger, wherein each clip (42) hangs from a stirrup attached to the second side (44) of the fan duct and which leaves an aperture (70) capable of being traversed by a pin (66) integral with one end wall (68) of the manifold (18), in such a way that the fitting of the fan duct onto the heat exchanger comprises a final insertion phase in which the blocks (34) penetrate into the respective housings (38) and simultaneously the pins (66) penetrate into the apertures (70) of the stirrups, and each stirrup (46) comprises a bridge (48) in which the aperture (70) is formed and to which the clip (42) is attached, as well as two branches (50) linking the bridge (48) to the second side (44) of the fan duct, in such a way that, during the final insertion phase, the clip (42) is first of all pushed away laterally under the action of the lug (60) then closes back, allowing the lug to penetrate into the aperture (58) in the clip.

4. The Module according to claim 3, wherein each lug (60) comprises a sloping wall (64), forming a ramp, in order to facilitate pushing-away of the clip (42).

5. The Module to one of claim 1, wherein the fan duct (12) comprises two clips (42), spaced apart, one of which is suitable for providing a positioning reference and the other for taking up dispersion between the second manifold (18) and the fan duct (12).

6. The Module according to claim 1, wherein the housings (38) of the first manifold (16) are formed as a U-shaped stirrup (40).

7. The Module according to claim 1, wherein the fan duct (12) comprises three spaced blocks (34) suitable for being engaged respectively in three housings (38) of first the manifold (16).

8. The Module according to claim 1, wherein the fan duct (12) as well as its blocks (34) and its clips (42) are produced in a single piece by moulding from a plastic.

9. The Module according to claim 1, wherein the first manifold (16) and its housings (34) a are produced in single piece by moulding from a plastic.

10. The Module according to claim 1, wherein the second manifold (18) and its lugs (60) are produced in a single piece by moulding from a plastic.

11. The Module according to claim 1, wherein the first manifold (16) and the second manifold (18) extend horizontally, respectively at the lower and the upper part of the heat exchanger.

12. The Module according to claim 1, wherein the heat exchanger (10) constitutes a radiator for cooling a motor-vehicle engine.

13. A Heat-exchange module comprising:

a heat exchanger having two horizontally extending manifolds, said heat exchanger having a plurality of housings secured to a first one of said manifolds, and at least two lugs extending from a second one of said manifolds;

a fan duct having at least two blocks which extend vertically outward from a first side of said fan duct and engages a corresponding one of said housings of said first manifold, at least two spring clips positioned proximate a second side of said fan duct, the spring clips each being equipped with an aperture to engage and retain one of said at least two lugs; and a stirrup disposed between said second side of said fan duct and each of said spring clips forming a connection there between.

14. The heat exchanger module according to claim 13, wherein each spring clip vertically hangs from a corresponding stirrup, said stirrups each having a second aperture retaining a pin extending from said second manifold.

15. The heat exchanger module according to claim 14, wherein said aperture of said spring clips are vertically aligned with a corresponding second aperture of said stirrups.

16. The heat exchanger module according to claim 13, wherein each stirrip includes a horizontally extending bridge vertically spaced apart from said second side of said fan duct, each of said spring clips extend from a corresponding one of said bridges towards said second side of said fan duct.

17. The heat exchanger module according to claim 16, wherein said bridges are connected to said second side of said fan duct by a pair of vertically extending branches.

18. The heat exchanger module according to claim 17, wherein said duct fan, said blocks, said stirrups, and said spring clips are all integrally formed of a single piece of plastic.

* * * * *